US005123333A

United States Patent [19]

Sollami

[11] Patent Number: 5,123,333

[45] Date of Patent: Jun. 23, 1992

[54] SEALS FOR HOUSING OF A ROTARY ACTUATOR

[76] Inventor: Phillip A. Sollami, 1300 E. Pine, Herrin, Ill. 62948

[21] Appl. No.: 604,110

[22] Filed: Oct. 29, 1990

[51] Int. Cl.[5] ..... F01C 9/00

[52] U.S. Cl. ..... 92/125; 92/121

[58] Field of Search ..... 92/120–125; 277/236

[56] References Cited

U.S. PATENT DOCUMENTS

| | | | |
|---|---|---|---|
| 1,957,605 | 5/1934 | Lamont . | |
| 2,339,042 | 1/1944 | Anderson . | |
| 2,796,776 | 6/1957 | Locke et al. . | |
| 3,025,087 | 3/1962 | Snow . | |
| 3,128,679 | 4/1964 | Trendle . | |
| 3,131,610 | 5/1964 | Paulus . | |
| 3,171,332 | 3/1965 | Randle | 92/125 |
| 3,179,020 | 4/1965 | Runsey et al. | 92/125 |
| 3,181,437 | 5/1965 | Rumsey et al. | 92/123 |
| 3,215,046 | 11/1965 | Drake . | |
| 3,288,202 | 11/1966 | Rumsey . | |
| 3,351,121 | 11/1967 | Rumsey . | |
| 3,368,818 | 2/1968 | Asamaki et al. . | |
| 3,370,638 | 2/1966 | Rumsey . | |
| 3,379,100 | 4/1968 | Rumsey et al. | 92/120 |
| 3,426,654 | 2/1969 | Laughman . | |
| 3,472,254 | 10/1969 | Reed et al. . | |
| 3,501,157 | 3/1970 | Doutt . | |
| 3,630,553 | 12/1971 | Foulger . | |
| 3,682,437 | 8/1972 | Miller . | |
| 3,999,770 | 12/1976 | Sollami . | |
| 4,066,007 | 1/1978 | Barlow . | |
| 4,303,251 | 12/1981 | Harra et al. . | |
| 4,495,856 | 1/1985 | Sollame | 92/125 |
| 4,941,554 | 7/1990 | Sollami . | |

FOREIGN PATENT DOCUMENTS 2159489 6/1973 Fed. Rep. of Germany .

*Primary Examiner*—Edward K. Look
*Assistant Examiner*—F. Daniel Lopez
*Attorney, Agent, or Firm*—Edmond T. Patnaude

[57] ABSTRACT

The present invention relates to a fluid operated device having a stator and a rotating vane mounted on a shaft enclosed in a cylindrical body with head members at each end of the housing. The pressure of the fluid is different on each side of the vane for such devices, and an elastomeric seal is provided on the vane to prevent leakage of fluid from one side of the vane to the other. The present invention provides for a metal to metal seal between the cylindrical body and the head members such that the elastomeric seal on the vane will seal against metal surfaces as it sweeps along the union of these two members.

7 Claims, 2 Drawing Sheets

SEALS FOR HOUSING OF A ROTARY ACTUATOR

The present invention relates to fluid operated devices in general, and specifically to rotary actuators having a body sleeve sealed to end covers by metal to metal seals which seal along annular lines around the body sleeve where it contacts the end plates.

BACKGROUND OF THE INVENTION

Rotary fluid operated devices employing a stator and a radial vane mounted on an oscillatory shaft may be used as an actuator by admitting pressurized fluid to one side of the vane while releasing fluid from the other side, or they may be used as constant torque resistance devices by regulating the flow of fluid from one side of the vane to the other side of the vane. The device usually has a body with a cylindrical bore and head assemblies at the two ends of the cylindrical bore. The vane on such devices carries a non-metallic sealing material to seal the vane against the inner walls of the bore and the head assemblies to prevent leakage from one side of the vane to the other.

A seal is also required around the ends of the bore, between the heads and the body, to prevent leakage of the liquid between the body and the head assemblies to the outside of the device. If a typical rubberized seal is used between these two parts, the corners of the seals on the vane, at the intersection of the sides of the vane with the outer edge of the vane, will drag along the inner edge of the non-metallic seal around the circumference of the union between the head assemblies and the bore as the vane rotates, and wear away both seals. The seal on the vane will fail at the corners of the vane, and leakage will occur.

The present invention relates to an annular metal seal which seals the body against the head, an example of such a seal can be found in my U.S. Pat. No. 4,495,856. This prior seal requires a flexible plate which is separate from the remainder of the head assembly, and is therefore, more expensive to manufacture than a single piece head assembly.

It would be desirable to create a head member from a single piece of metal which would provide a metal to metal seal where the body sleeve meets the head member around the circumference of the bore.

BRIEF DESCRIPTION OF THE INVENTION

This invention relates to fluid operated devices having a stator and a rotating vane mounted on a shaft enclosed in a cylindrical body with head members at each end of the housing. To seal the head members to the housing and also to seal the corners of the vane against leakage around the vane as it sweeps along the union of the body and the head members, an annular metal to metal seal is provided around the inside circumference of the body where it contacts the head members.

A counterbore is provided on the body which forms an inner annular sealing surface and a second annular surface disposed radially outward from the sealing surface. Similarly, an annular groove is provided on the head member to form an annular sealing surface and a second annular surface disposed radially outward of the sealing surface. The inner perimeter of the annular sealing surface on the body is raised or disposed relative to the outer perimeter of the annular sealing surface. Also the distance between the inner perimeter of the annular sealing surface of the body and the second annular surface is less than the distance between the annular sealing surface and the second annular surface of the head member. When the head member is assembled to the body the inner perimeter of the annular sealing surface on the body contact the sealing surface of the head member before the second annular surfaces of the head and body abut each other. When the head members are tightened to the body, causing the second annular surfaces to abut each other, the metals of the sealing surfaces deform beyond their elastic limits along a contiguous line around the inner circumference of the sealing surfaces, creating a fluid tight metal to metal seal.

GENERAL DESCRIPTION OF THE DRAWINGS

The present invention will be better understood by a reading of the following detailed description taken in connection with the accompanying drawings wherein.

DETAILED DESCRIPTION OF PREFERRED EMBODIMENTS OF THE INVENTION

Figure 1:
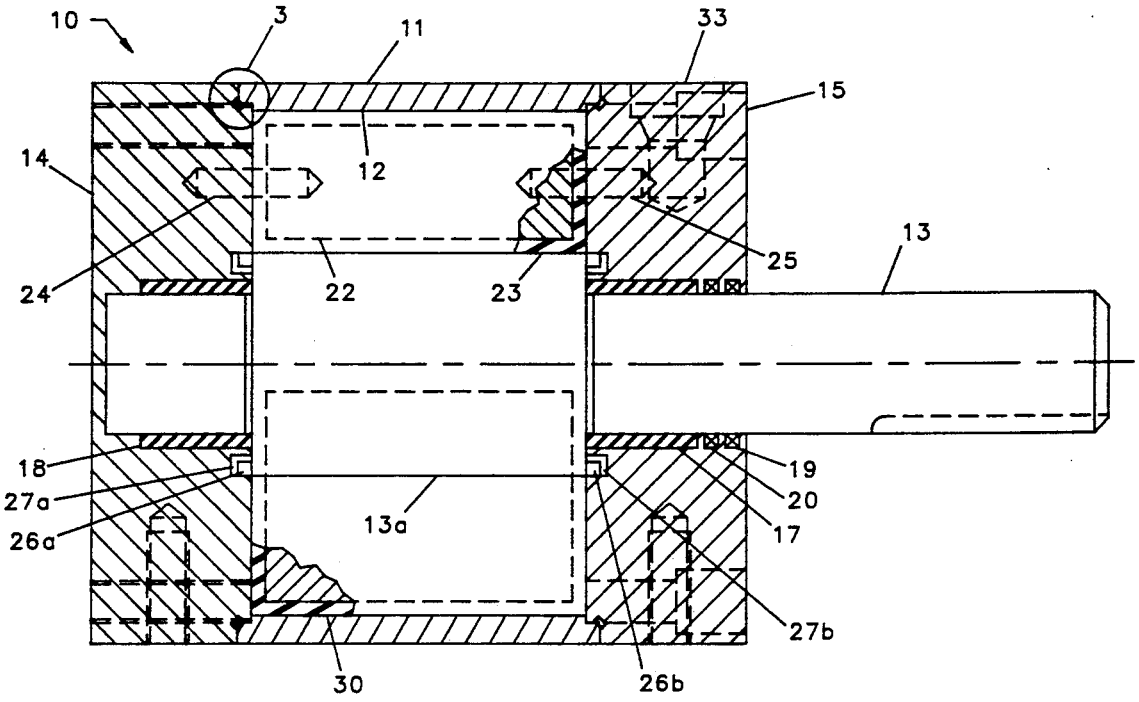
FIG. 1 is a longitudinal cross-sectional view of the preferred embodiment of the invention.

Referring to FIG. 1, a fluid operated rotary device 10 includes a body in the form of a tubular metallic housing 11 having a cylindrical bore 12 along the longitudinal axis of which a shaft 13 is located. The two ends of the housing 11 are respectively covered by a pair of head members 14 and 15. The shaft 13 passes through at lest one of the head members, in this case, member 15. Both head members incorporate bearings or journals 17 and 18 which rotatably support the shaft and secure that shaft within the head members. As shown, head member 15 has a pair of seals 19 and 20 to prevent leakage of fluid from the device. As can best be seen in FIG. 2, the device 10 further includes a longitudinal stator 21 sealably mounted against the inside surface of the bore 12 and having a groove 22 along its sides and outer edge. An elastomeric U-shaped seal 23 is mounted inside the groove 22 o the stator 21 and seals the side edges of the stator 21 against the head members 14 and 15, and seals the distal edge of the stator 21 against the shaft 13. As shown in FIG. 1, the stator 21 is positioned within the housing 11 by a pair of longitudinally extending pins 24 and 25 in head members 14 and 15 respectively.

Figure 2:
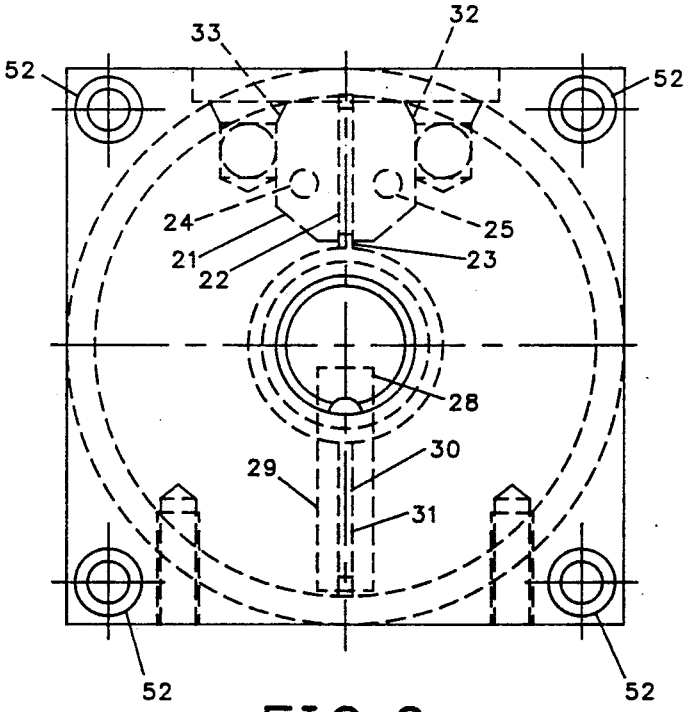
FIG. 2 is an end cross-sectional view of the embodiment shown in FIG. 1.

The shaft 13 includes an enlarged intermediate section 13a, and a pair of elastomeric annular seals 26a and 26b are mounted in annular grooves 27a and 27b in the respective head members 14 and 15 and compressed against intermediate section 13a of the shaft 13. A groove 28 extends along the intermediate portion 13a of the shaft 13, and as best seen in FIG. 2, a radial vane 29 is inserted into groove 28. The vane 29 extends longitudinally along the shaft 13 from one head assembly to the other and rotates with the shaft. The vane has a groove 30 along its two sides and outer edge in which is inserted another elastomeric U-shaped seal 31 which seals the vane against the surface of the bore 12 and the inner surfaces of the head members 14 and 15.

Figure 5:
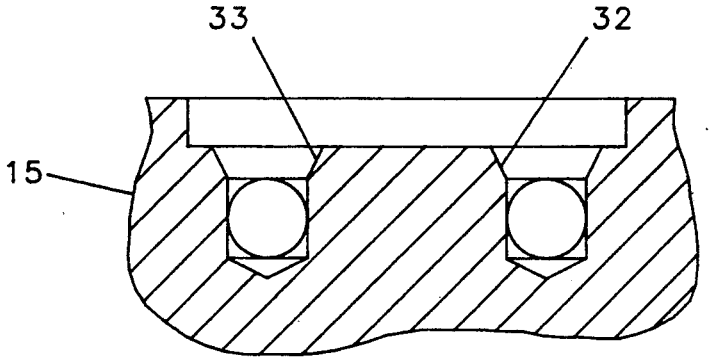
FIG. 5 is a fragmentary cross-sectional enlargement of the head member in which the input and exhaust ports are located.

As shown in FIGS. 1, 2 and 5, the head member 15 is provided with fluid input and exhaust ports 32 and 33, each of such ports for permitting the flow of fluid to or from one side of the stator 21. Injection of fluid into the chamber on one side of the stator 21 while releasing fluid from the chamber on the other side of the stator 21 causes the rotation of the vane 29 and therefore rotation of the shaft 13 in one angular direction causing the device 10 to operate as an actuator. The device can also serve as a constant torque resistance device by connecting exhaust ports 32 and 33 to each other through a valve which regulates the flow of fluid from one side of the vane 29 to the other side of the vane 29.

Figure 3:
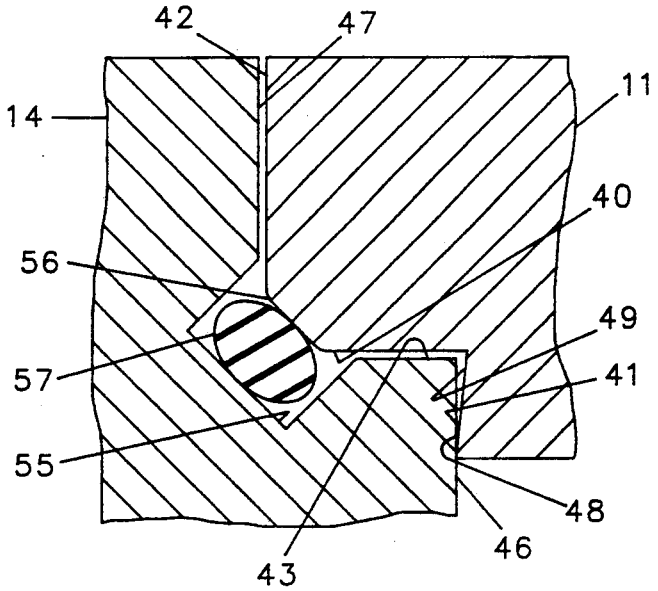
FIG. 3 is an enlargement of the longitudinal cross-section shown in FIG. 1 particularly showing the area of the engagement of one head member with the body prior to tightening the head members to the body.
Figure 4:
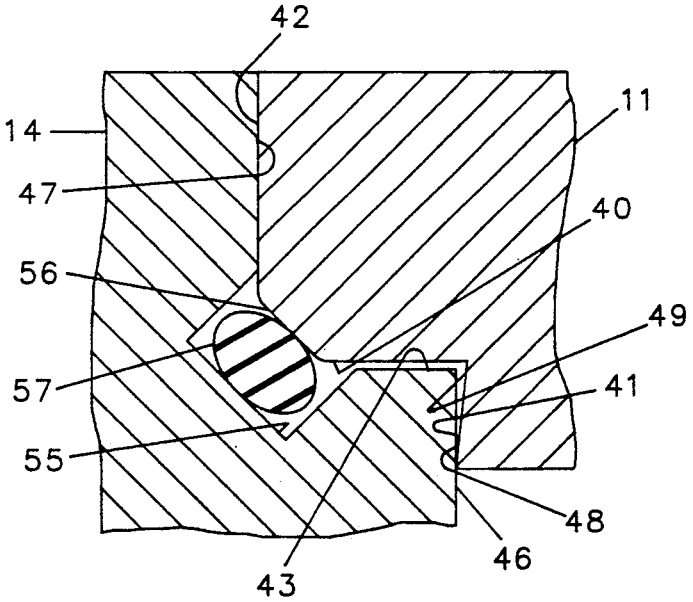
FIG. 4 is another enlargement of the longitudinal cross-section as shown in FIG. 3, after the head members have been tightened to the body.

As can be seen in FIG. 3 and FIG. 4, which are cross-sectional enlargements showing the engagement of the body 11 with the head member 14, each of the outer ends of the body 11 has a counter bore 40 which forms a first outwardly facing annular shoulder or sealing surface 41 and a second outwardly facing annular surface 42 disposed radially outwardly of the sealing surface 41. Correspondingly, the head member 14 has a first annular sealing surface 46 which opposes annular sealing surface 41 of the body 11, and a second annular surface 47 which opposes the second annular surface 42 of the body 11, the two annular surfaces 46 and 47 being axially disposed relative to each other by a counter bore 43. The sealing surface 46 of the head member 14 is not parallel to the sealing surface of the body 41. The inner edge 48 of the annular sealing surface 41 of the body is axially closer to surface 42 than to the outermost edge 49 of the annular sealing surface 41, as can best be seen in FIG. 3. Also, the axially distance between inner edge 48 and the second annular outwardly facing surface 47 is less than the axially distance between the annular sealing surface 46 of the head member 14 and the second annular surface 42 of the head member. Accordingly, when the head member 14 is initially assembled to the body 11, the inner edge 48 of sealing surface 41 of the body 11 contacts the annular sealing surface 46 of the head member before the second annular surface 42 of the body contacts the second annular surface 47 of the head member.

Referring to FIG. 2, the head member 15 further includes four equally spaced holes 52, through which are passed bolts, not shown, and which extend into threaded holes, not shown, in head member 14 such that tightening of the bolts compress the head members 14 and 15 against the ends of the body 11. Tightening of the bolts will ultimately result in the second annular surface 47 of the head being pressed against and abutting the second annular surface 42 of the body 11, as shown in FIG. 4. Along the annular lines of contact 48 between the body 11 and the head members, the metals of each will be deformed beyond their elastic limits and a metal to metal seal will be formed.

Referring further to FIG. 3, an annular groove 55 is provided in the head member 14 at a position disposed radially outwardly from sealing surfaces 41 and 46 between the annular Surface 47 and the counter bore 43. Opposing the groove 55 is a flatten annular surface 56 on the body member 11 between counterbore 40 and the annular sealing surface 47 such that the groove 55 and the flatten surface 56 define an annular space in which is inserted an elastomeric annular gasket or O-ring 57. When the device is initially assembled, the metal to metal seal along the annular ridge 48 prevents leakage of fluid outside of the device. However, the maintenance of such devices often requires that the head members be disassembled from the body, after which the metal to metal seal may no longer prevent leakage of fluid to the outside of the device. The O-ring 57 provides a secondary seal and becomes of primary importance when the metal to metal seal is broken. In such cases, fluid may seep from within the device to the outside unless prevented by the additional seal 57. Although the metal to metal seal may leak to a minimal extent after disassembly and reassembly thereof for maintenance, it will continue to provide a sufficiently tight seal to prevent leakage around the vane seal 30.

The vane 29 and the stator divide the bore into two fluid tight chambers. Rotation of the shaft 13 and the vane 29 in one direction cause the volume of a first chamber to increase while the volume of the second chamber decreases. Conversely, the rotation of the shaft 13 and vane 29 in the opposite direction cause the volume of the second chamber to increase while the volume of the first chamber decreases.

As previously stated, the device may be used either as a rotary actuator or as a constant torque resistance device such as used in certain types of exercise equipment. When used as an actuator, fluid is admitted under pressure at one of the input and exhaust ports 32 or 33, which exerts pressure against one side of the vane 29. Simultaneously, fluid is released from the other input and exhaust port, 32 or 33, causing the shaft 13 and vane 29 to rotate. When utilized as a constant resistance device, the two input and exhaust ports 32 and 33 are connected to each other through a valve. When a torque is exerted against the shaft, the shaft 13 rotates and the vane 29 expels fluid from the chamber on one side of the vane 29 while fluid is admitted into the chamber on the other side of the vane 29.

Whether the device is used as a rotary actuator or as a constant torque resistance device, the pressure of the fluid in the chamber on one side of the vane 29 will be different from the pressure of the fluid in the other side of the vane 29. It is desirable to prevent leakage of fluid into or out of the two chambers except through the input or exhaust ports 32 and 33, and therefore elastomeric seal 31 is provided to prevent leakage of fluid around the edges of the vane 29.

Since the vane 29 rotates, the elastomeric seal 31 must seal the vane 29 as it sweeps around the inside of the bore 12 and along the inner surfaces of the head members 14 and 15. Seals are available which provide a good seal on a moving body when compressed against a stationary, smooth, metallic surface such as the bore and the head members. The elastomeric seal 31 must also provide a good seal along the line of contact between the bore 12 and the head members 14 and 15. When a metal to metal seal is provided in accordance with the present invention, the elastomeric seal 31 is at all times sweeping along metal surfaces.

While the present invention has been described in connection with one embodiment, it will be understood by those skilled in the art that many changes and modifications may be made without departing from the true spirit and scope of the present invention. Therefore, it is intended by the appended claims to cover all such changes and modifications which come within the true spirit and scope of the invention.

What is claimed:

1. A fluid operated reciprocatory device, comprising in combination:

a body member formed of metal and having a cylindrical bore therein, first and second unitary head members formed of metal and fixedly mounted to said body over the respective ends of said bore with an annular end surface on each of said head members abutting a respective annular outer end surface of said body, a shaft extending through said bore and through at least one of said head members, said shaft being journalled for rotation in said head members, a radially disposed longitudinal stator mounted in said body member between said head members, a radially disposed, longitudinal vane fixedly mounted to said shaft and extending from said first head member to said second head member, first sealing means carried by said stator for sealing said stator to said shaft and to said head members, second sealing means carried by said vane for sealing said vane to said body and said head members, said head members each having an annular counterbore defining said annular end surface and an annular sealing surface which engages an annular sealing surface on said body member, said body being provided with counterbores at the ends thereof defined by outwardly facing annular shoulders on said body member, one of said annular shoulders on said body being said sealing surface on said body, said annular sealing surfaces on said body member being spaced from the respective ends of said body member by distances sufficiently less than the distances from the ends of said annular sealing surfaces on said head members and said annular end surfaces on said head members, such that said annular sealing surface on each of said head members is deformed beyond its elastic limits along an annular line surrounding said bore in said body member.

2. A device according to claim 1 comprising:

a plurality of elastomeric annular gaskets respectively compressed between the ends of said body member and said head members, said gaskets being disposed radially outward of said annular sealing surfaces.

3. A fluid operated device in accordance with claim 1 wherein said annular sealing surface on each end of said body member is deformed beyond its elastic limits along a line surrounding said bore in said body member.

4. A fluid operated device in accordance with claim 3 further comprising:

an annular groove in each of said head members between said counterbore and said annular end surface and radially outwardly of said sealing surface, and a plurality of elastomeric annular gaskets respectively compressed one in each of said annular groove in said head members.

5. A fluid operated device in accordance with claim 4 where said annular groove extends both radially into said counterbore and longitudinally into said annular end surface of each of said head members and a chamfer between said counterbore and said end surface at each end of said body member compresses one of said gaskets into each of said groove.

6. A fluid operated reciprocatory device, comprising in combination:

a body member formed of metal and having a cylindrical bore therein, first and second unitary head members formed of metal and fixedly mounted to said body over the respective ends of said bore with an annular end surface on each of said head members abutting a respective annular outer end surface of said body, a shaft extending through said bore and through at least one of said head members, said shaft being journalled for rotation in said head members, a radially disposed longitudinal stator mounted in said body member between said head members, a radially disposed, longitudinal vane fixedly mounted to said shaft and extending from said first head member to said second head member, first sealing means carried by said stator for sealing said stator to said shaft and to said head members, second sealing means carried by said vane for sealing said vane to said body and said head members, said head members each having an annular counterbore defining said annular end surface and an annular sealing surface which engages an annular sealing surface at each end of said body member, said body being provided with counterbores at the ends thereof defined by outwardly facing annular shoulders on said body member, said annular sealing surface at each end of said body member being spaced from the respective ends of said body member by distances sufficiently less than the distances from the ends of said annular sealing surface on each of said head members and said annular end surface on each of said head members, such that said annular sealing surface at each end of said body member is deformed beyond its elastic limits along an annular line surrounding said bore in said body member.

7. A fluid operated device in accordance with claim 7 wherein said annular sealing surface on each of said head members is deformed beyond its elastic limits along a line surrounding said bore in said body member.

* * * * *

UNITED STATES PATENT AND TRADEMARK OFFICE

CERTIFICATE OF CORRECTION

PATENT NO. : 5,123,333

DATED : June 23, 1992

INVENTOR(S) : Phillip Sollami

It is certified that error appears in the above-identified patent and that said Letters Patent is hereby corrected as shown below:

In column 6, at line 53, after "claim" delete "7" and substitute --6--.

Signed and Sealed this

Thirty-first Day of August, 1993

Bruce Lehman

*Attest:*

BRUCE LEHMAN

*Attesting Officer*

*Commissioner of Patents and Trademarks*